US006543638B2

(12) United States Patent
Wile

(10) Patent No.: US 6,543,638 B2
(45) Date of Patent: Apr. 8, 2003

(54) METHOD AND MEANS OF DISPENSING T-SHIRT TYPE BAGS

(76) Inventor: Richard Wile, 26 Stagecoach Rd., Medfield, MA (US) 02090

( * ) Notice: Subject to any disclaimer, the term of this patent is extended or adjusted under 35 U.S.C. 154(b) by 81 days.

(21) Appl. No.: 09/808,922

(22) Filed: Mar. 15, 2001

(65) Prior Publication Data

US 2001/0023873 A1 Sep. 27, 2001

Related U.S. Application Data

(60) Provisional application No. 60/187,586, filed on Mar. 7, 2000.

(51) Int. Cl.[7] ..... B65G 59/00
(52) U.S. Cl. ..... 221/1; 206/554
(58) Field of Search ..... 221/1, 33, 185; 211/12, 59.1, 181.1; 248/95; 206/554

(56) References Cited

U.S. PATENT DOCUMENTS

| | | | | |
|---|---|---|---|---|
| 4,519,504 A | | 5/1985 | Nausedas | 206/554 |
| 4,793,539 A | | 12/1988 | Haenni et al. | 225/106 |
| 4,819,899 A | * | 4/1989 | Weil | 211/133.2 |
| 4,849,090 A | | 7/1989 | Case et al. | 206/390 |
| 5,184,728 A | | 2/1993 | Wile | 206/554 |
| 5,524,763 A | | 6/1996 | Wile | 206/554 |
| 5,584,402 A | * | 12/1996 | Johnson | 206/554 |
| 5,590,784 A | | 1/1997 | Daniels | 206/554 |
| 5,690,228 A | | 11/1997 | DeMatteis | 206/554 |

* cited by examiner

*Primary Examiner*—Kenneth W. Noland
(74) *Attorney, Agent, or Firm*—Perkins, Smith & Cohen, LLP; Jacob N. Erlich; Jerry Cohen

(57) ABSTRACT

A method and means of dispensing T-shirt type plastic bags from a rack mounted beneath a counter from a tray which slides horizontally into an existing industry standard rack which interlocks with the rack but when needed for loading, can be pulled forward, tilted downward, and loaded with bags and slid back into the rack, where it will align, hold and dispense bags. Optionally, a new frame can be mounted under the counter and a second tray (similar to the first tray) is held within the same frame so that it can hold two different size bags, allowing one frame to dispense two different size bags. Alternatively, a frame can be made to hold only one tray if space is limited. In all three forms the horizontal tray slides forward and tilts downward to receive pads of plastic bags. Only the T-shirt handles and the upper half of the bags are contained within the frame or rack. The lower half of the bags drape over and downward from the front of the rack. The user can grasp any part of the bag to withdraw it from the rack. The bags have a unique arrangement in the handle cut out area whereby they have two punched holes at the mouth of the bag for mounting on the rack trays. Additionally, there are several frangible bonds to the outside of the handle cut out area of the bag to bond together a pad of about 100 bags.

9 Claims, 4 Drawing Sheets

METHOD AND MEANS OF DISPENSING T-SHIRT TYPE BAGS

Priority is claimed based on Provisonal Application U.S. PTO 60/187,586 "Budget Handisack", filed Mar. 7, 2000.

BACKGROUND OF THE INVENTION

1. Field of the Invention

The present invention is directed to the holding and dispensing of T-shirt type plastic bags, and more particularly to a system which holds proprietary T-shirt type bags in a convenient, yet out of the way position beneath a counter and allows a user to withdraw one bag at a time.

2. Brief Description of the Related Art

The Prior Art discloses a number of systems, which allow for mounting of T-shirt type bags under a counter. Examples of such dispensing systems are disclosed in U.S. Pat. Nos. 5,584,402; 5,524,763; 5,184,728; 4,793,539; and 4,849,090.

The 'check out' area of retail and convenience stores is usually a small confined area. It is difficult to find space to put plastic bags where they are conveniently located for use by the check out clerk. Where there is counter space, a rack shown in U.S. Pat No. 5,690,228 is used as a bagging system. The counter in most retail stores is usually too high and too compact to allow a bagging system of this type. Such a system is more often found in large grocery stores at the end of check out counters. In most retail stores the bags must be stored under the counter. Originally, the bags were stored in boxes placed on shelves under the counter. This system required the clerk to bend over in order to reach a bag. Additionally, it was difficult to grasp just one bag at a time as the bags in the box became jumbled. The clerk most often pulled out a handful of bags which created a hazard and was also very wasteful of bags.

Systems ultimately were developed to place the bags immediately under, and suspended from, the counter top. Such systems are disclosed in U.S. Pat. Nos. 5,524,763; 4,849,090; 4,793,539; 5,584,402; and 5,184,728. These systems worked reasonably well and placed the bags conveniently near the check out clerk. Unfortunately, each of these systems has certain drawbacks and limitations. The bags for the systems covered by U.S. Pat. Nos. 5,524,763; 4,849,090; and 5,184,728 are all proprietary bags and are more expensive to manufacture and assemble than standard inline T-shirt plastic bags. Ultimately, the customer must pay the premium for these bags. The bags for U.S. Pat. No. 5,584, 402 are standard manufacture in line T-shirt bags but the rack for the system is cumbersomely large, and does not fit in the small spaces beneath check out counters, and presents only one size bag to the user.

Cost cutting competitive retail chains require bags manufactured in a standard in line manufacturing process in order to keep prices to a minimum. Therefore, they seek a bag dispensing system which places the bags conveniently close to the check out clerk, uses bags made by the most economical manufacturing methods, and utilizes a dispensing rack which is compact and preferedly dispenses more than one size bag from the same dispenser.

SUMMARY OF THE INVENTION

It is an object of the present invention to provide a bag, tray, and rack system which dispenses at least two sizes of T-shirt type plastic bags from a convenient position under a counter in a retail or convenience store.

Another object of the present invention is to develop a rack which is small enough to fit under the counter in the vast majority of front-end retail and convenience store check out areas.

Another object of the present invention is to present a bag to the user in a manner most convenient for them to grasp one bag at a time.

Another object of the present invention is to provide a rack which will hold multiple bags in a neat aligned fashion so that the user can easily withdraw one bag at a time without the handles becoming tangled and disarrayed, or curled in over the release area, interfering with a user's ability to withdraw a bag. The bags have two mounting holes punched in the mouth area which, when mounted on the rack, prevent the handles from coming together and tangling.

Another object of the present invention is to provide a compact dispensing rack which will dispense two different size bags to a user as needed.

Another object of the present invention is to provide a compact dispensing rack which will alternatively mount on a vertical surface in the event there is no space under the counter to install a rack.

Another object of the present invention is for the bag system to use T-shirt bags manufactured and assembled by industry standard in line processes, which, when used, will prevent the handles from folding together and becoming tangled, thus preventing the user from easily grasping a bag.

DESCRIPTION OF THE DRAWINGS

These and other objects, features and advantages of the invention will best be understood with the aid of the following detailed description in conjunction with the accompanying drawings in which.

Before describing the first embodiment of the present invention, a description of the industry standard rack will be reviewed. Thousands have been sold and are in use today.

The industry standard rack fits under the counter of most convenient store check out counters. They are fastened to the underside of the counter surface with clips and wood screws. They are designed to receive a bundle of plastic bags encased at one end by a cardboard box. The open end of the boxed bundle of bags hang out of the bottom when the cardboard box end of the bundle is installed in the rack. A clamp drops down into a slotted opening in the box which holds the bundle in place as bags are removed one at a time. The problem with this arrangement is cost and storage. The cardboard box portion adds significantly to the overall cost of a bundle of bags. The box also takes up additional storage space in the shipping container and in storage. Finally, when the bags are used up, the box must be removed and discarded. In manufacturing, significant extra labor is required to fold and lock the upper portions of the bags within the cardboard box. This activity is shown in U.S. Pat. No. 5,184,728. In addition to additional labor, extra materials are needed and the finished boxes require more space. As will be seen later, the instant invention is made up of approximately 100 bags to a pad (analogous to a pad of paper, i.e., a "pad" of bags) which in turn are shipped in a container having about 100 pads of large bags for a total of 1,000 bags or approximately 400 pads of small bags for a total of 4,000 bags. These containers take up less than half the storage space that boxed bags require.

The present invention costs 20% less than the prior art bundle and uses half the storage space and leaves nothing behind when the final bag is used. To prepare the industry standard rack for the present invention, the movable central swivel lock that drops into the slotted portion within the cardboard box, must be held up out of the way with a twist tie. A user merely pushes up the moveable lock and with a twist tie fastens it to the top part of the rack out of the way so that the new tray of the present invention can slide into place.

Figure 1:
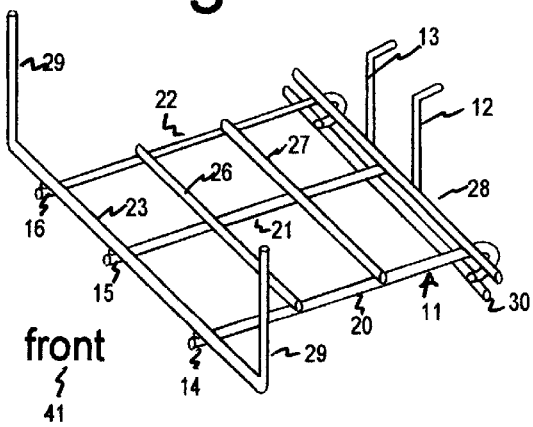
FIG. 1. is a tray, with two mounting spikes and spacer balls, which fits and locks into an industry standard rack.

Referring to FIG. 1, we see tray 11 which has two spikes 12 and 13. These spikes are used to receive a bundle of plastic bags which have two mating holes (130 & 131 FIG. 13) through an entire pad 42 FIG. 3. Tray 11 slides into the rack described above which receives it, and locks into position such that bags may be pulled out one at a time by tearing each bag away from the spikes while the other bags remain held together in a bundle by a number of frangible bonds. Frangible bonds are made in a pad of bags during manufacture by exerting significant pressure at a small point (approximately ¼ inch) in the pad of plastic bags (approximately 100). These bonds hold all the bags in a pad together until needed, i.e., pulled apart from the pad, one bag at a time.

The ends 14, 15, and 16 show three balls that have been welded between the rods 20, 21, and 22 where they are affixed to rod 23. The balls raise the tray rod 23 a small distance above the rods 14, 15, and 16 such that the end of the rods drop down below the rack's outer edge holding the tray firmly in place. This small distance helps lock the tray into the frame automatically and makes it easier to pull on the bags one at a time and tear one off the pad without pulling the tray from the rack. Rods 26, 27, and 28 make up the remaining base of the tray. The sides 29 of the tray hold the sides of a pad of bags in place when the pad is placed on the tray.

The entire tray and rack for that matter can be formed of one quarter inch steel wire or equivalent that is welded at its junctions with the other wire components.

Figure 2:
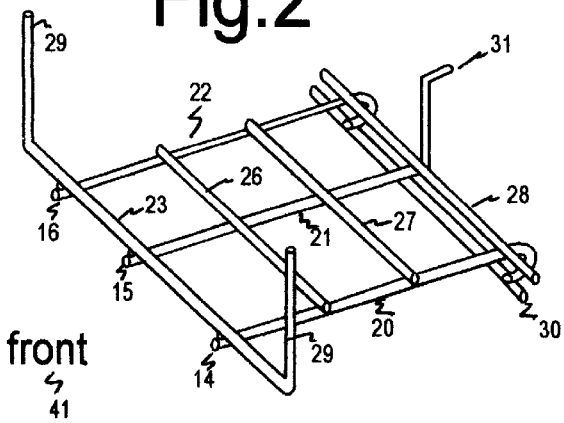
FIG. 2. is a an alternate tray, with one mounting spike and spacer balls, which also fits and locks into an industry standard rack.

Referring to FIG. 2, we see a slightly different tray than the one shown in FIG. 1, it has only one spike 31. This one spike is useful with small bags which only have one hole punched through the pad. The purpose of having two spikes for large bags as opposed to one for small bags provides more stability to the pad of large plastic bags held in a tray.

Figure 3:
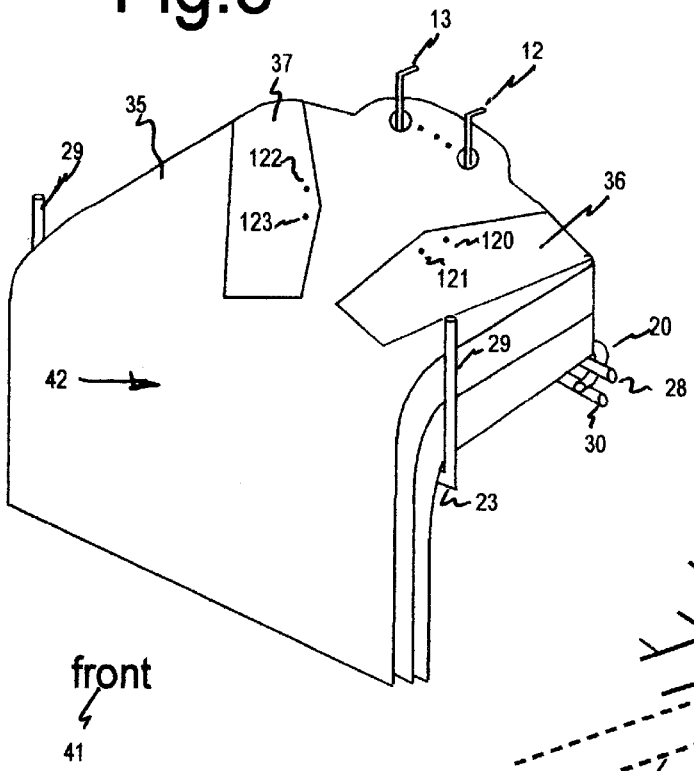
FIG. 3. shows the tray in FIG. 1 loaded with bags.

Referring to FIG. 3, we see a pad of plastic bags 35 placed in a tray 11. The ends (29) of rod 23 hold the bundles of bags in neat alignment. Spikes 12 and 13 receive the bundle of bags 35 through holes 130 and 131 that have been punched into the bundle during manufacture. The frangible bonds 124, 125 and 126 are put into the pad by pressing a metal prong with great force up against the pad of approximately 100 bags during manufacture. Frangible bonds separate easily with a gentle force when a bag is pulled from the pad. The T-shirt arms used for carrying the bag when filled with groceries are shown as 36 and 37. The bags drape (as shown 42) over the tray edge (rod 23) toward the front 41. Frangible bonds hold the bag handle (i.e. T-shirt) portion 120, 121 and 122 and 123 together during storage so that they do not get tangled with the frame in addition to holding the bags in a pad with the help of frangible bonds 124, 125, and 126. The later frangible bonds also serve to keep the hole 130 and 131 in the pad of bags in registration with each other.

Figure 4:
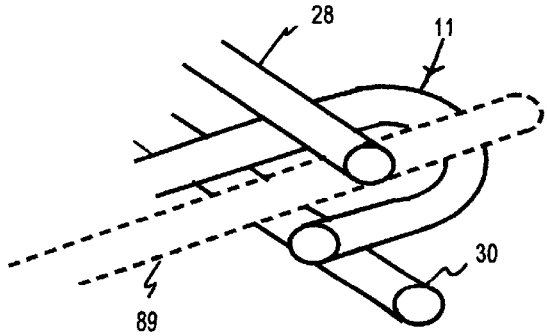
FIG. 4. is the back right portion of the tray which fits and locks into an industry standard rack.

Referring to FIG. 4, we see one corner of a new tray for use with the existing industrial standard rack referred to above. Rod ends 28 and 30 are arranged so that the rack side rail 89 holds the tray in place. The user pulls the tray outward, then places a new pad on the tray and then slides the tray back within the rack so that the rods ride smoothly on the rails located on either side of the industry standard rack. [See phantom rail 89.] When first installing the tray, it is off-set by tilting the tray up and turned to fit the rods 30 and 28 under the side rails 89 of the industry standard rack (not shown except in phantom). The procedure is simple and obvious to a user in the field. Once installed, the tray never needs to be removed entirely again. New pads of bags are quickly installed by lifting the front end of the tray, sliding it out along the rails until it drops down into a vertical position with the rack, and hooking on a new pad of bags over spikes 12 and 13 (or 31 for small bags and a single spike unit).

Often the bags are loaded onto the tray and the tray is slid back into the rack. The ends of cross support rods 16, 15, and 14 drop down below the front edge of the rack when the tray is slid back into place, thereby holding the tray firmly in place so that bags can be pealed or torn off one at a time.

Figure 5:
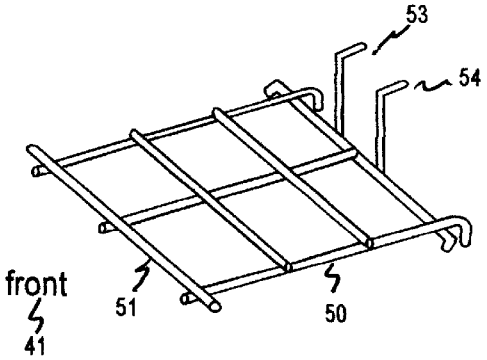
FIG. 5. is a tray, with two mounting spikes without side bars to hold the bags steady, which fits and locks into a frame shown in FIG. 7.
Figure 6:
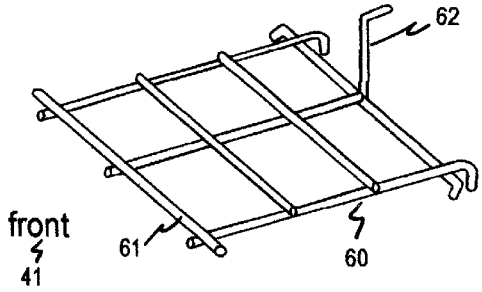
FIG. 6. is an alternative tray, with one mounting spike which also fits and locks into a frame shown in FIG. 7.
Figure 7:
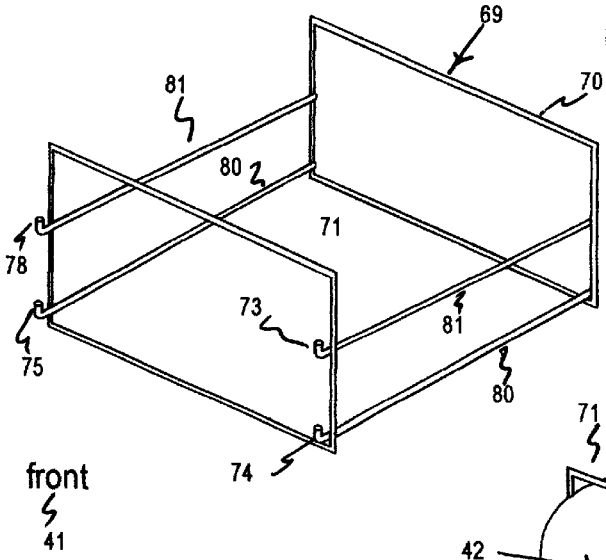
FIG. 7. is a two tier frame into which two trays (FIG. 5) or (FIG. 6) can be placed.

Referring to FIGS. 5 and 6, simpler trays are shown which can be installed in a mating new frame which replaces the industrial standard where needed. Rod 51 of the tray 50 has no rising ends 29 to hold the bundle of bags for they are not needed. This vertical sides of frame 70 and 71 provide the means to hold the trays and bags they contain in place.

A tray 50 will be placed in a new frame 69 such that it will slide in and out along the lower rails 80 of the frame. The tray's rod 51 will drop into mating loops 74 and 75 to hold the tray firmly in place.

A tray 60 FIG. 6 with only one spike 62 can also be used in the same manner as tray 50 described above. Two trays can be used with frame 70 one at the lower level of rails 80 and another at the higher level of rails 81.

Figure 8:
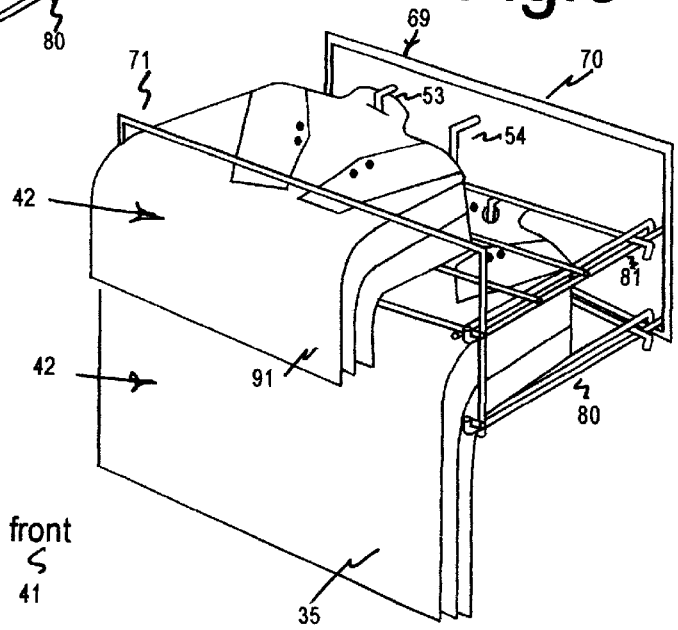
FIG. 8. is a frame with two trays installed and filled with two different size bags.

FIG. 8 shows a fully loaded rack 70. The lower tray on level 80 has a pad of larger bags 35 and the upper tray on level 81 with a pad of smaller bags 91. Only one of the spikes 13 is used with the single hole 92 in pad 91. Both pad of bags have their ends draped over the tray at the front end 41 as shown by arrow 42.

It is readily seen that a user can peel and tear off a small bag or a large bag one at a time easily without disturbing the remaining bags in either pad.

Figure 9:
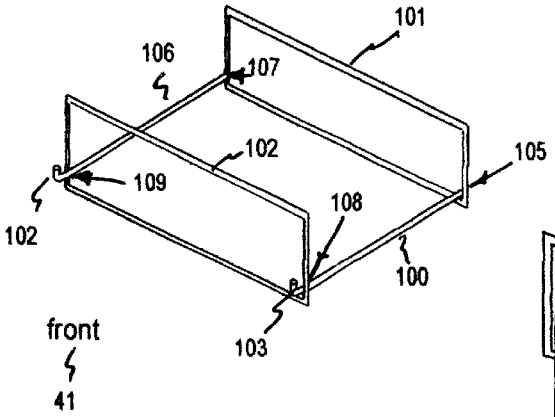
FIG. 9. shows a single tray frame.

Referring to FIG. 9 we see a frame which is designed to accept only one tray. The rack is made up of two identical components 101 and 102 which are bent to form a rectangular frame. The rods 101 and 102 form a smooth continuous structure separated by two rails 100 and 106 welded to them. The two frame pieces are then held apart by the two rails of the same material which are welded to the inside of the piece at points 108 and 109 and at the other end at 107 and 105. The rods 100 and 106 have a ½ inch bent up end 102 and 103 which forms a small pocket to receive and hold in a tray.

Figure 10:
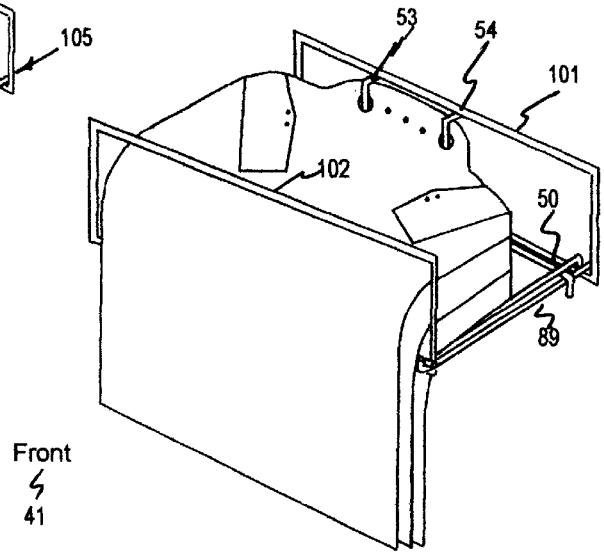
FIG. 10 shows the frame (FIG. 9) with tray (FIG. 5) installed and filled with one size bags.

FIG. 10 shows a frame 101 with a fully loaded tray 50 installed in it.

Figure 11:
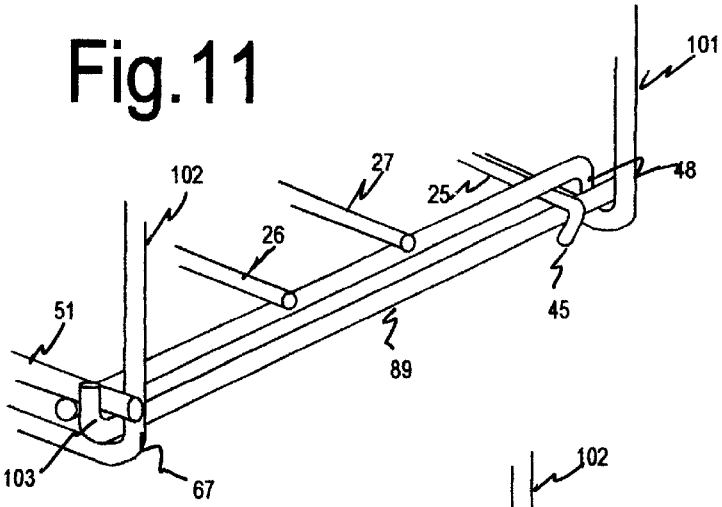
FIG. 11 shows a detailed portion of the interlocking lower right rails of the frame (FIG. 7 or 9) and tray (FIG. 5 or 6) in closed position.

Referring to FIG. 11, we see one side of the frame with a tray in a bag dispensing position. Both trays 50 and 60 (FIGS. 5 and 6) are identical in form so only one side need be shown to show how they work. The tray 50 with rod 51 is firmly held in place by the bent up end 103 on rail 89 which forms an integral part of frame 101. Rod 51 can be lifted up slightly and the tray can then slide out along rail 89. The ends 45 and 48 hold the tray in place as it slides out.

Figure 12:
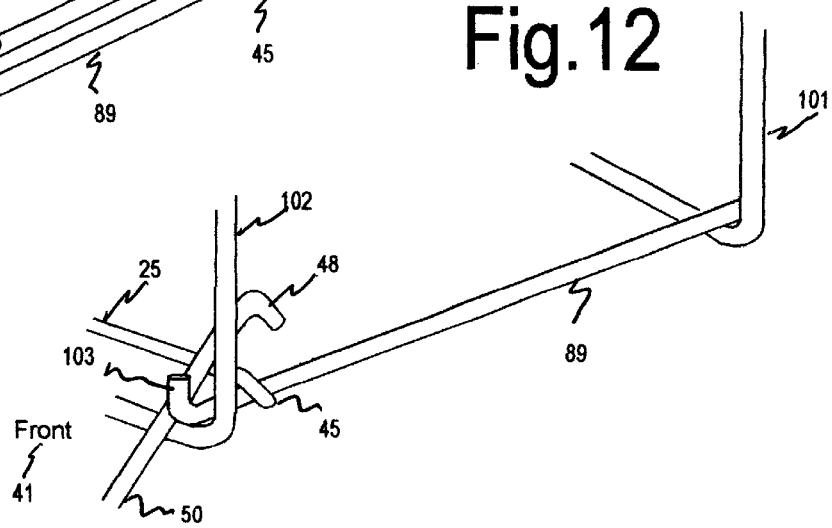
FIG. 12 shows a detailed portion of the interlocking lower right rails of the frame (FIG. 7 or 9) and tray (FIG. 5 or 6) in open (loading) position.
Figure 13:
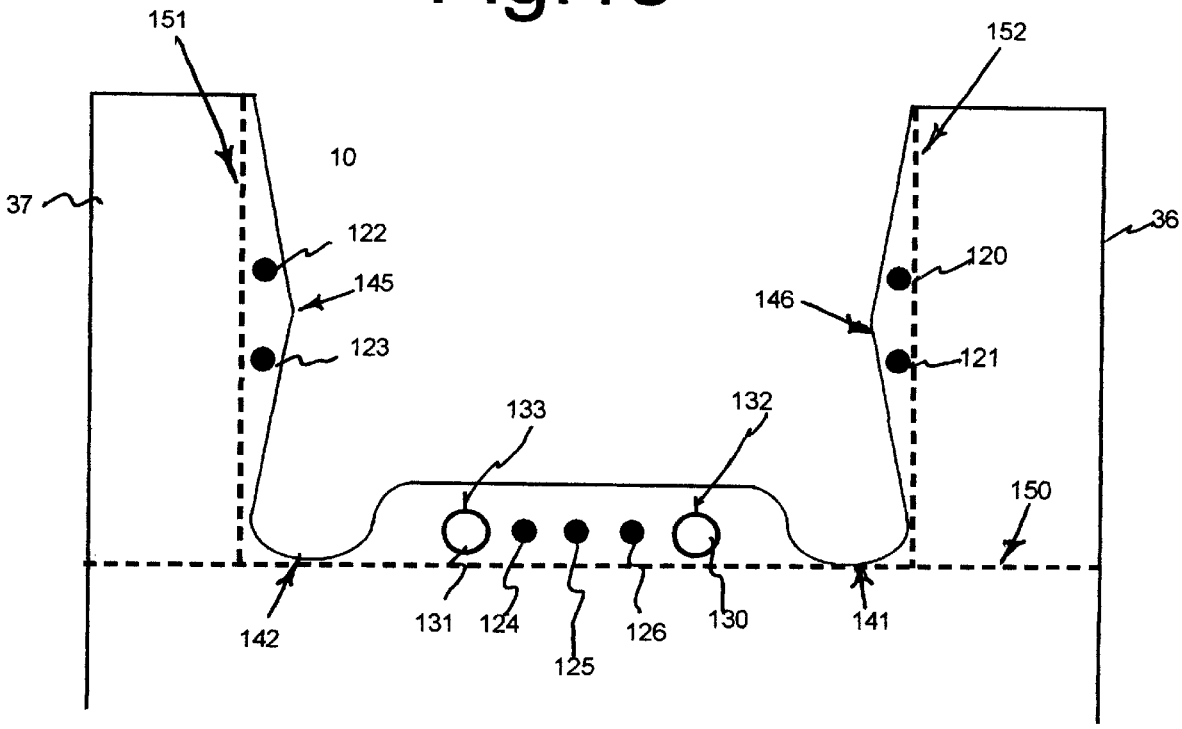
FIG. 13 shows the die cut handle area of the top of a pad of plastic bags.

Referring now to FIG. 12, we see the tray 50 fully withdrawn. The bend 45 prevents the tray from complete removal. Note that the tray drops down but not out. A new pad of plastic bags can then be placed into the tray over spikes 53 and 54. The tray can then be pushed back into the rack which will be locked into place when end 67 of rod 51 drops into the pocket formed by the bend 103 shown in FIG. 11. Referring to FIG. 13, we see the top bag of a pad of plastic bags. A pad of bags is produced in a machine that packages them in a large group and holds them together by frangible bonds 120, 121, 122, 123, 124, 125, and 126. Holes 130 and 131 are punched through the material to enable the bundle to be placed over the spikes 53 and 54 of the tray. Note cuts 132 and 133. The purpose of these directional tear cuts is to permit the bag to be easily torn off one at a time and leave no material behind connected to spikes 53 and 54.

The T-shirt handles 36 and 37 are stamped out of the plastic bundle to form handles for each bag during manufacture. The cut out portions 141 and 142 up to the peaks 145 and 146 are important, they prevent possible destructive tears that might possibly be present from defects due to frangible bonds 120, 121, 122, and 123 slightly tearing the bags, resulting in a tear running down into the body of the bag. A tear once started in plastic will continue to run left unchecked. The tear must be limited along a controlled direction by causing it to run out of material. Tears are to be avoided below tangent line 150 and outside lines 151 and 152 at all cost. The integrity of the bag once loaded with groceries will be compromised if a tear extends beyond these lines. The placement of frangible bonds, hole punches, and directional tear slits must be limited to the pattern shown to prevent tears migrating beyond the stress lines 150, 151, and 152 as shown. As bag thickness varies, it will be necessary to use more or less frangible bonds. However, all frangible bonds and hole punches must be above line 150 and inside of lines 151 and 152. These lines can be referred to as stress lines. When a bag is full of groceries, cuts above the line will not result in a bag tear so that groceries will fall out of the bag. Tears on the inside of stress lines 151 and 152 will likewise protect the handle from tearing when the bag is picked up placing stress on the handles.

The plastic bags for this application are provided in pads (i.e. bundles) of approximately 100. The number of bags is limited because of the frangible bonds. Too many bags in a pad and the bonds may fail, and the bags separate before being pulled on.

It is to be noted that frangible bonds 124, 125, and 126 are located around holes 131 and 130 to insure that their registration with one another in the pad of bags until used.

Several frangible bonds 122, 123, 120 and 121 are used in the sleeve 37 and 36 of the pad 42 of bags. These bonds also hold the sleeves together in the pad so that they can be folded over out of the way so that they will not get tangled while in the tray waiting to be used.

Each tray can hold about 3 or 4 pads of bags. A supply of between 3 or 4 hundred bags meet all the needs of most retailers. It would be unusual for a retailer to reload a tray more than once a day. Four hundred bags could last for a few days before reloading was required in most retail situations.

Once a pad of bags is shipped to a user, the user merely folds over the sleeves 37 and 36 and places the pad over the spikes 13 and 12 or 53 and 54 and slips the tray into the rack or frame. It will be readily seen that a manufacturer can ship a multitude of pads in a single box to be used as needed, this keeping storage requirements to a minimum.

Summarizing:

In one embodiment of the present invention the objectives are accomplished by a metal wire frame which can be installed up under a counter or down onto a shelf. Two wire metal trays are so fabricated that they can be slid horizontally, one above the other, into a frame. The trays are so constructed that once installed, they are locked into the frame and cannot be easily removed even in the forward (loading) position. Each tray can individually slide forward within the frame and then be tilted downward. In this position, pads of plastic T-shirt type bags can be hung from holes or slits at the mouth of the bag located between the bag handles, on the two mounting spikes positioned perpendicular to the tray. After loading, the tray is then lifted to horizontal and slid back into the wire frame where it automatically locks in place. The tray is not as long as the bags and contains only approximately the upper half of the bags and the handles of the bags. The lower portion of the bags drape over the front edge of the tray and hang down vertically. The smaller of the two sizes of bags is mounted in the upper tray and the larger bag is mounted in the lower tray. Since the smaller bag is also shorter, it does not drape very far over the lip of the tray. Thus, the smaller bags will not interfere with access to the larger bags in the tray below. This two-tray arrangement allows two sizes of bags to be conveniently located for use by the check out clerk, in a minimal amount of space.

In another embodiment of the invention the frame is smaller (less tall) and holds only one tray. In the situation where there is not enough height for a two tiered rack, two single tray racks can be mounted side by side to present two different sizes of bags; or a single one tray rack can be used for the customer who wants only one size bag. In any event, the single tray rack functions in the same manner as the two tray rack where the horizontal tray slides out and downward to be loaded and then is lifted to horizontal and slid back into the rack frame. The lower portion of the bags continue to drape over the front edge of the tray and then hang downward.

In a third embodiment of the invention, a tray, similar to those above, interlocks into an already installed industry standard under counter rack. The tray lays horizontally within the rack, pulls forward and then tilts downward to be loaded with bags. After loading, it is lifted to horizontal and slid back within the rack frame until it automatically locks.

The two front corners of each tray have vertical posts which confine the bags within the inner limits of the rack frame and keep the bags aligned with one another. The lower portion of the bags continue to drape over the front edge of the tray and then hang downward. In this situation, where a customer already has installed industry standard under counter racks, the customer needs only to purchase the tray to convert from an expensive patented dispensing system to a system which dispenses T-shirt type plastic bags made via more traditional, less expensive, in line manufacturing techniques. The user therefore can reduce his bag costs while utilizing the under counter racks he already has.

This completes the designation of the preferred embodiments of the invention. Those skilled in the art may recognize other equivalents to the specific embodiments described herein which equivalents are intended to be encompassed by the claims attached hereto.

What is claimed is:

1. In combination with an industry standard T-shirt bag dispenser, a method of dispensing T-shirt type plastic bags comprising the steps of, removably securing a central swivel lock for holding cardboard encased bags in place to the top of a frame, selecting a tray insertable within a rack of the dispenser that locks in place when fully placed in said rack and slidable out to the front end of said rack to a tilting position, said tray having at least one spike to receive a bundle of the T-shirt type plastic bags and vertical side rods to hold the bundle in place, selecting a bundle of the plastic bags that have preselected sleeves cut therefrom and held together with multiple frangible bonds and at least one hole that register with other plastic bags forming the bundle, and placing said bundle in said tray by engaging said at least one hole with said at least one spike of said tray.

2. The method of dispensing T-shirt type plastic bags according to claim 1 wherein said bags are factory cut so that individual bags tear off clear from the bundle.

3. The method of dispensing T-shirt type plastic bags according to claim 2 wherein said tray has two spikes.

4. The method of dispensing T-shirt plastic bags according to claim 2 wherein said tray has one spike.

5. The method of dispensing T-shirt type plastic bags according to claim 1 further comprising the step of locking said tray in place within said rack by dropping said tray's front rod below the front edge of said rack.

6. The method of dispensing T-shirt type plastic bags according to claim 1 wherein said bags are factory cut so that individual bags tear off from said pad without injury to the mouth or sleeve of said bags so that they are able to hold bags therein and be carried by said sleeves.

7. A method of dispensing T-shirt type plastic bags comprising the steps of:

selecting a frame having a pair of outer rods and an open portion therein for receiving at least one tray, said frame capable of being mountable under a counter, selecting a tray having at least one spike attached substantially at the back portion of said tray for receiving a pad of the T-shirt type plastic bags on the at least one spike, inserting said tray within said open portion of said frame by sliding outer edges of said tray along said pair of outer rods of said frame, locking said tray in place within said frame when said tray is fully placed within said open portion of said frame, partially removing said tray from said open portion of said frame by unlocking said tray from said frame by sliding said tray from said frame and tilting said tray downward with respect to said frame until said tray locks in the tilted downward position, selecting a bundle of the T-shirt type plastic bags that have preselected sleeves cut therefrom held together with multiple frangible bonds, and at least one hole at a mouth of each of said bags, loading said tray with the T-shirt type plastic bags by folding the sleeves over and inserting the at least one hole at the mouth of the bags onto the at least one spike, thereby resting an end of the T-shirt type plastic bags substantially at the back portion of said tray, and reinserting and locking said tray back within said open portion of said frame by sliding outer edges of said tray along said pair of outer rods of said frame until said frame is substantially completely within said open portion of said frame.

8. The method of dispensing T-shirt type plastic bags as defined in claim 7 wherein said frame has provisions for two separate trays, further comprising the steps of inserting first and second trays within said frame and wherein a lower tray holds large bags and an upper tray holds smaller bags.

9. A T-shirt type bag dispensing system, comprising:

a supporting structure made up of front and rear spaced-apart vertical frames, each of said vertical frames forming an open portion therein, said front and rear spaced-apart, vertical frames being held in the spaced apart relationship with one another by a pair of spaced-apart elements;

each of said pair of elements having an upturned portion on one end thereof;

at least one tray for holding a packet of T-shirt-type bags, said at least one -tray having a frame-like configuration and being made up of a front element, a rear element and a pair of side elements, all elements being interconnected together;

said rear element having at least one spike upstanding therefrom and further having downturned outer ends; and wherein, said tray is capable of moving between a locked position with respect to said supporting structure when said front element of said tray engages said upturned portion of each of said pair of elements of said supporting structure, and a tilted position in which said downturned outer ends of said rear element of said tray engages said front frame of said supporting structure.

* * * * *